US006168684B1

(12) United States Patent
Mitsuhashi et al.

(10) Patent No.: US 6,168,684 B1
(45) Date of Patent: Jan. 2, 2001

(54) WAFER POLISHING APPARATUS AND POLISHING METHOD

(75) Inventors: Hideo Mitsuhashi; Satoshi Ohi; Atsushi Yamamori; Shoichi Inaba, all of Tokyo (JP)

(73) Assignee: NEC Corporation, Tokyo (JP)

( * ) Notice: Under 35 U.S.C. 154(b), the term of this patent shall be extended for 0 days.

(21) Appl. No.: 09/205,695

(22) Filed: Dec. 4, 1998

(30) Foreign Application Priority Data

Dec. 4, 1997 (JP) ..... 9-333947

(51) Int. Cl.[7] ..... C23F 1/02; B24B 5/00; B24B 29/00

(52) U.S. Cl. ..... 156/345; 451/287

(58) Field of Search ..... 156/345; 216/88–92; 451/285–288

(56) References Cited

U.S. PATENT DOCUMENTS

| | | | | |
|---|---|---|---|---|
| 5,205,082 | * | 4/1993 | Shendon et al. | 51/283 |
| 5,643,061 | * | 7/1997 | Jackson et al. | 451/289 |
| 5,931,725 | * | 8/1999 | Inaba et al. | 451/288 |

FOREIGN PATENT DOCUMENTS

| | | |
|---|---|---|
| 58-154051 | 10/1983 | (JP) . |
| 64-34661 | 2/1989 | (JP) . |
| 7-237120 | 9/1995 | (JP) . |
| 7-266220 | 10/1995 | (JP) . |
| 8-11055 | 1/1996 | (JP) . |
| 9-193010 | 7/1997 | (JP) . |
| 9-246218 | 9/1997 | (JP) . |
| 9-295263 | 11/1997 | (JP) . |
| 10-34530 | 2/1998 | (JP) . |
| 10-94959 | 4/1998 | (JP) . |
| 10-113862 | 5/1998 | (JP) . |
| 10-286758 | 10/1998 | (JP) . |

* cited by examiner

*Primary Examiner*—Gregory Mills
*Assistant Examiner*—Alva C. Powell
(74) *Attorney, Agent, or Firm*—Young & Thompson

(57) ABSTRACT

A wafer polishing apparatus has a rotary polishing bed, an abrasive cloth provided on the polishing bed, an abrasive supply supplying abrasives to a surface of the abrasive cloth, a wafer depressor depressing the wafer onto the abrasive cloth at a predetermined pressure, a ring shaped retainer arranged surrounding the wafer and provided with a plurality of grooves extending between an inner peripheral edge and an outer peripheral edge on a surface contacting with the abrasive cloth, a rotary driver driving the wafer and the retainer on the abrasive cloth, and a rotation speed difference generator providing a difference of rotation speeds between the wafer and the retainer.

11 Claims, 10 Drawing Sheets

WAFER POLISHING APPARATUS AND POLISHING METHOD

BACKGROUND OF THE INVENTION

1. Field of the Invention

The present invention relates generally to a wafer polishing apparatus and a polishing method. More particularly, the invention relates to a wafer polishing apparatus and a polishing method applicable for a chemical and mechanical polishing for planarization of an uneven portion on a semiconductor wafer formed through a semiconductor device fabrication process.

2. Description of the Related Art

FIG. 10 shows a graph showing a shape after polishing of an outer peripheral portion of a wafer in the case where chemical and mechanical polishing for planarization of an uneven portion on a semiconductor wafer formed through a semiconductor device fabrication process. In FIG. 10, a horizontal axis represents a position in a radial direction from an outer peripheral portion of the wafer toward the center, and a vertical axis represents a residual layer thickness of the wafer.

Typically, a wafer polishing apparatus performs chemical and mechanical polishing supplies an abrasives to a rotating abrasive cloth and performs polishing by pressing the abrasive cloth onto the wafer. In this case, a ring called as retainer for preventing the wafer from jumping out during polishing process, is arranged for surrounding the wafer. In FIG. 10, a curve represented by (a) shows a shape of wafer in the case where the retainer does not contact with the polishing cloth. In general, the shape of the outer peripheral portion of the wafer after polishing is a shape in the case where the retainer is pressed onto the polishing cloth. A curve represented by (b) shows a shape of wafer in the case where the retainer is in contact with the abrasive-cloth. In general, the shape of the outer peripheral portion of the wafer after polishing is differentiated depending upon whether the retainer is pressed onto the abrasive cloth or not. It has been known that better or higher flatness can be obtained as shown by the curve of (a) in FIG. 10.

In the semiconductor fabrication process, an amount of the semiconductor chips obtained from a single wafer (hereinafter referred to as yield) depends upon an area of a flat region of the wafer. In case of the curve shown by (a) of FIG. 10, namely in the case where the retainer is pressed onto the abrasive cloth, higher flatness can be obtained in the outer peripheral portion of the wafer to achieve higher yield from one wafer to lower fabrication cost. Accordingly, in view of this, it is advantageous to press the retainer on the abrasive cloth in view point of the fabrication process. However, in this case, since the retainer surrounds the wafer, when the lower surface of the retainer is flat, supply of the abrasives to a polishing surface of the wafer is interfered to lower a polishing speed or to case lack of polishing at the center portion of the wafer.

A polishing apparatus solving the problems set forth above has been disclosed in Japanese Unexamined Patent Publication No. Heisei 7-237120.

The wafer polishing apparatus disclosed in the above-identified Japanese Unexamined Patent Publication No. Heisei 7-237120 will be discussed with reference to FIG. 9.

The wafer polishing apparatus shown in FIG. 9 is constructed with a rotatable polishing bed 52, an abrasive cloth 3 provided on the polishing bed, an abrasives supply portion 5 supplying an abrasives 4 on the surface of the abrasive cloth 3 by means of a pump or the like, a carrier head 6 holding a wafer 1 as an object of polishing, a retainer 9 surrounding the wafer 1, fixed to the carrier head 6 in so as to be placed at a height to depress the abrasive cloth 3 around the wafer 1 during polishing and provided with a plurality of grooves 10 on the surface contacting with the abrasive cloth 3, a pressurizing mechanism 14 depressing the wafer 1 and the retainer 9 toward the abrasive cloth 3 together with the carrier head 6, and a spindle 13 driving the wafer 1 and the retainer 9 on the abrasive cloth 3 together with the carrier head 6.

The conventional wafer polishing apparatus shown in FIG. 9 supplies the abrasives 4 to the rotating abrasive cloth 3 and performs polishing by rotating the spindle 13 with depressing the wafer 1 onto the abrasive cloth 3 by means of the pressurizing mechanism 14, similarly to the typical apparatus for performing chemical and mechanical polishing. At this time, since the retainer 9 is also depressed onto the abrasive cloth 3, good flatness can be obtained on the outer peripheral portion of the wafer 1 as shown in FIG. 10(*a*) to increase yield. On the other hand, since a plurality of grooves are provided on the retainer 8, the abrasives 4 is supplied to the polishing surface of the wafer through these grooves 10 to solve the problem of lowering of the polishing speed and lacking of polishing at the center portion of the wafer 1.

However, such conventional wafer polishing apparatus still remains a problem in synchronous rotation of the wafer and the retainer via the carrier head.

Namely, the conventional wafer polishing apparatus can differentiate inflow amount of the abrasives at portions where the grooves are formed and portions where the grooves are not formed for synchronous rotation of the wafer and retainer to cause fluctuation of polishing amount in the circumferential direction of the wafer and correspondingly cause lowering of the yield.

On the other hand, the conventional wafer polishing apparatus cannot control supply and discharge of the abrasives to the wafer polishing surface. A polishing chip and reaction product generated according to progress of polishing can be accumulated below the wafer polishing surface. By this, scratching of the wafer surface and lowering of the polishing speed can be caused.

SUMMARY OF THE INVENTION

The present invention has been worked out in view of the problems in the prior art. Therefore, it is an object of the present invention to provide a wafer polishing apparatus and a polishing method which can increase yield with eliminating fluctuation of polishing amount and can prevent occurrence of scratching and lowering of polishing speed by accumulation of reaction products.

According to the first aspect of the present invention, a wafer polishing apparatus comprises:

- a rotary polishing bed;
- an abrasive cloth provided on the polishing bed;
- abrasives supplying means for supplying an abrasives to a surface of the abrasive cloth;
- wafer depressing means for depressing the wafer onto the abrasive cloth at a predetermined pressure;
- a ring shaped retainer arranged surrounding the wafer and provided with a plurality of grooves extending between an inner peripheral edge and an outer peripheral edge on a surface contacting with the abrasive cloth;
- rotary driving means for driving the wafer and the retainer on the abrasive cloth; and rotation speed difference generating means for providing a difference of rotation speeds between the wafer and the retainer.

According to the second aspect of the present invention, a wafer polishing method comprises the steps of:

supplying an abrasives to a surface of an abrasive cloth provided on a rotary polishing bed;

driving a wafer as an object for polishing and a retainer arranged surrounding the wafer for rotation with depressing the wafer onto the abrasive cloth at a predetermined pressure by the retainer; and causing a difference of rotation speeds of the wafer and the retainer.

According to the third aspect of the present invention, a wafer polishing method comprises the steps of:

supplying an abrasives to a surface of an abrasive cloth provided on a rotary polishing bed;

driving a wafer as an object for polishing and a retainer arranged surrounding the wafer for rotation with depressing the wafer onto the abrasive cloth at a predetermined pressure by the retainer, in which the abrasives is supplied to a surface of the wafer to be polished in one rotating direction of the wafer and the retainer, and the abrasive is discharged from the surface of the wafer to be polished in the other rotating direction; and switching rotating direction between the one direction to the other direction.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscure the present invention.

Figure 1:
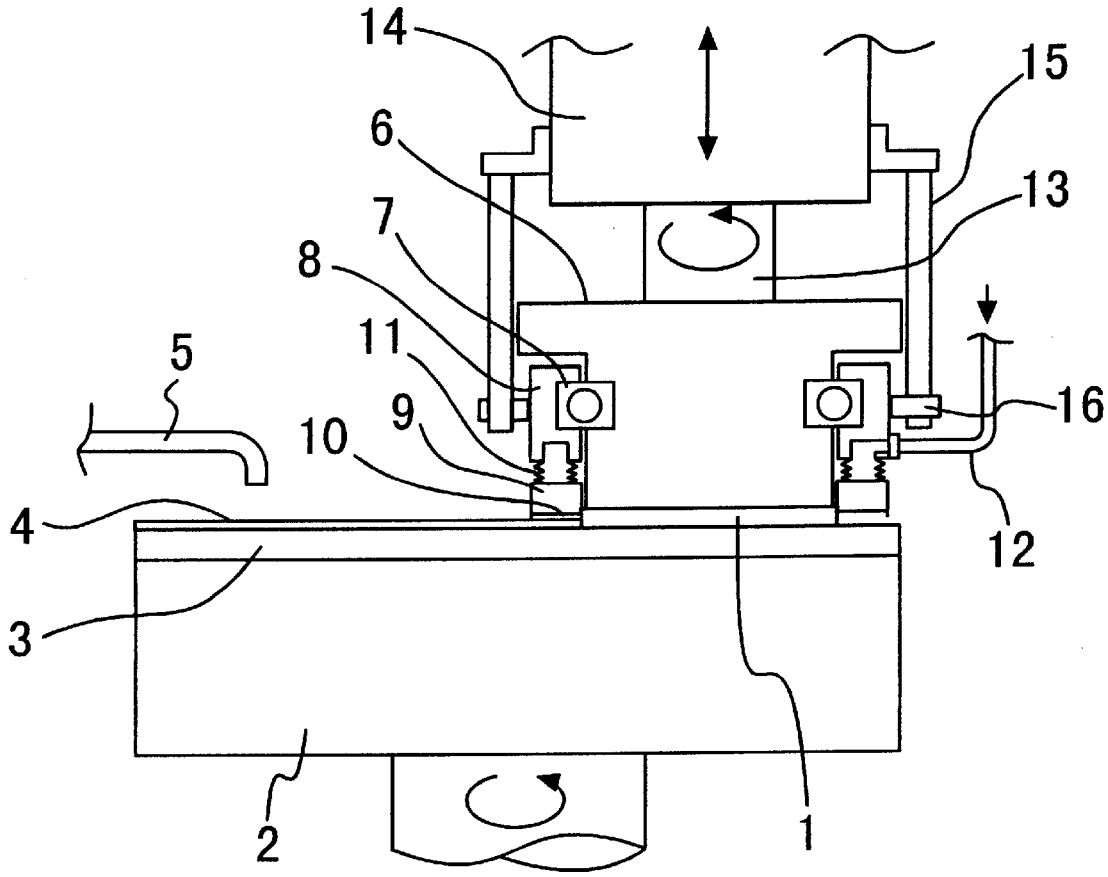
FIG. 1 is an illustration showing a construction of the first embodiment of a wafer polishing apparatus according to the present invention.

FIG. 1 is an illustration showing a construction of the first embodiment of a wafer polishing apparatus according to the present invention. The wafer polishing apparatus shown in FIG. 1 is constructed with a rotatable polishing bed 2, an abrasive cloth 3 provided on the polishing bed 2, an abrasives supply portion 5 supplying an abrasives 4 on the surface of the abrasive cloth 3 by means of a pump or the like, a carrier head 6 holding the wafer as an object for polishing, a cross roller bearing 7 having an inner ring rigidly fixed on the carrier head 6, a retainer base 8 on a ring internally defining a flow path of a compressed air, a ring-shaped retainer 9 arranged surrounding the wafer 1 and provided with a plurality of grooves 10 on a surface contacting with the abrasive cloth 3, a bellows 11 disposed between the retainer base 8 and the retainer 9 and depressing the retainer 9 into the abrasive cloth 3 with a predetermined pressure by introducing a compressed air of the predetermined pressure thereinto through a flow path of the retainer base, an air tube 12 supplying the compressed air into the flow path of the retainer base 8, a spindle 13 connected with the carrier head 6 and driving to rotate the wafer on the abrasive cloth 3 together with the carrier head 6, a non-rotatable pressurizing mechanism 14 depressing the wafer 1 onto the polishing cloth 3 at a predetermined pressure via the spindle 13 and the carrier head 6, two stoppers 15 rigidly fixed to the pressurizing mechanism 14 and arranged in vertical direction so that the tip ends thereof are positioned on both sides of the carrier head 6, and two shafts 16 rigidly fixed to the retainer base 8, projecting horizontally toward both sides of the carrier head 6, contacting with a stopper 15 upon rotation of the carrier head 6 for stopping rotation of the retainer base 8 and the retainer 9.

Figure 2:
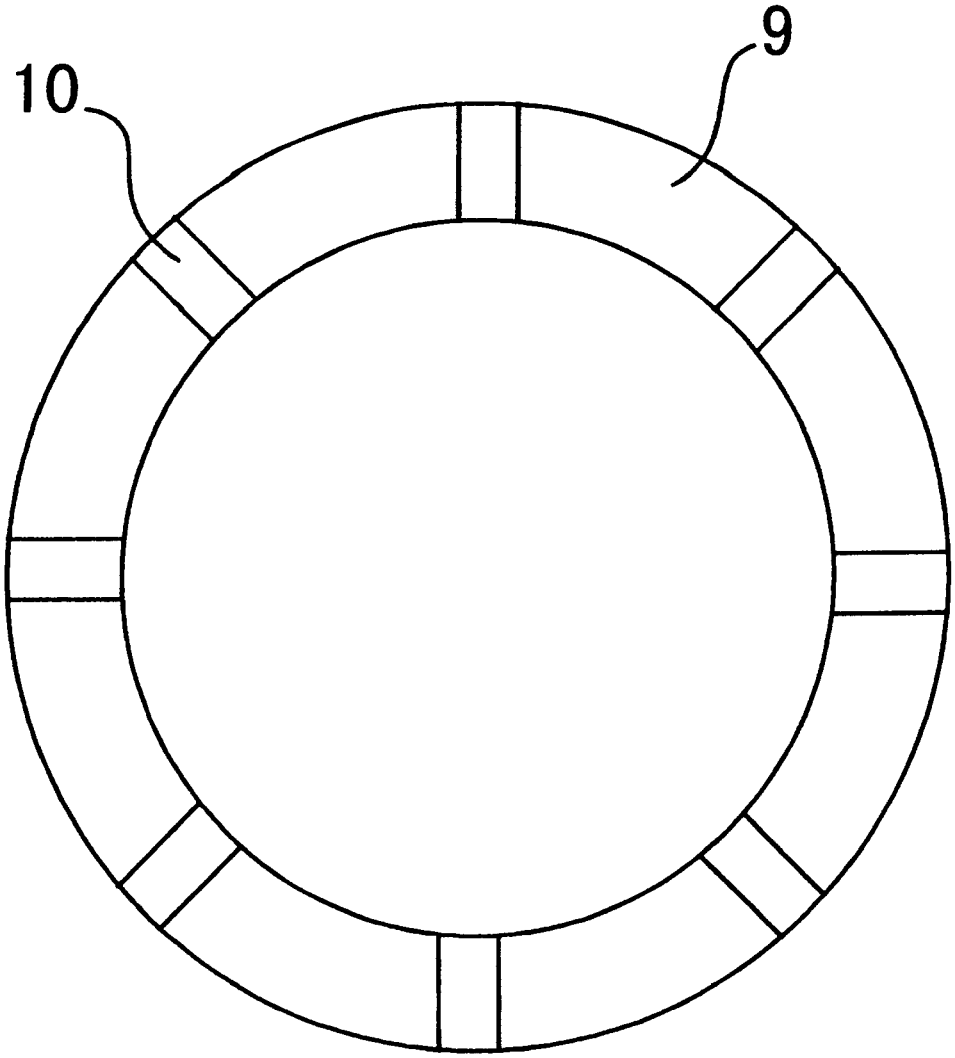
FIG. 2 is a plan view showing an embodiment where grooves are provided in a retainer of the first embodiment of the wafer polishing apparatus shown in FIG. 1.

FIG. 2 is an illustration showing the first embodiment of the grooves 10 provided on the retainer 9. The grooves 10 are formed linearly toward the center of the retainer 9.

Next, operation will be discussed.

Similarly to conventional wafer polishing apparatus, polishing of the wafer 1 can be performed by driving the spindle 13 to rotate by supplying the abrasives 4 to the abrasive cloth 3 rotating associating with rotation of the polishing bed 2 from the abrasives supply portion 5 and by depressing the wafer 1 onto the abrasive cloth 3 together with the carrier head 6 by means of the pressurizing mechanism 14.

Figure 3:
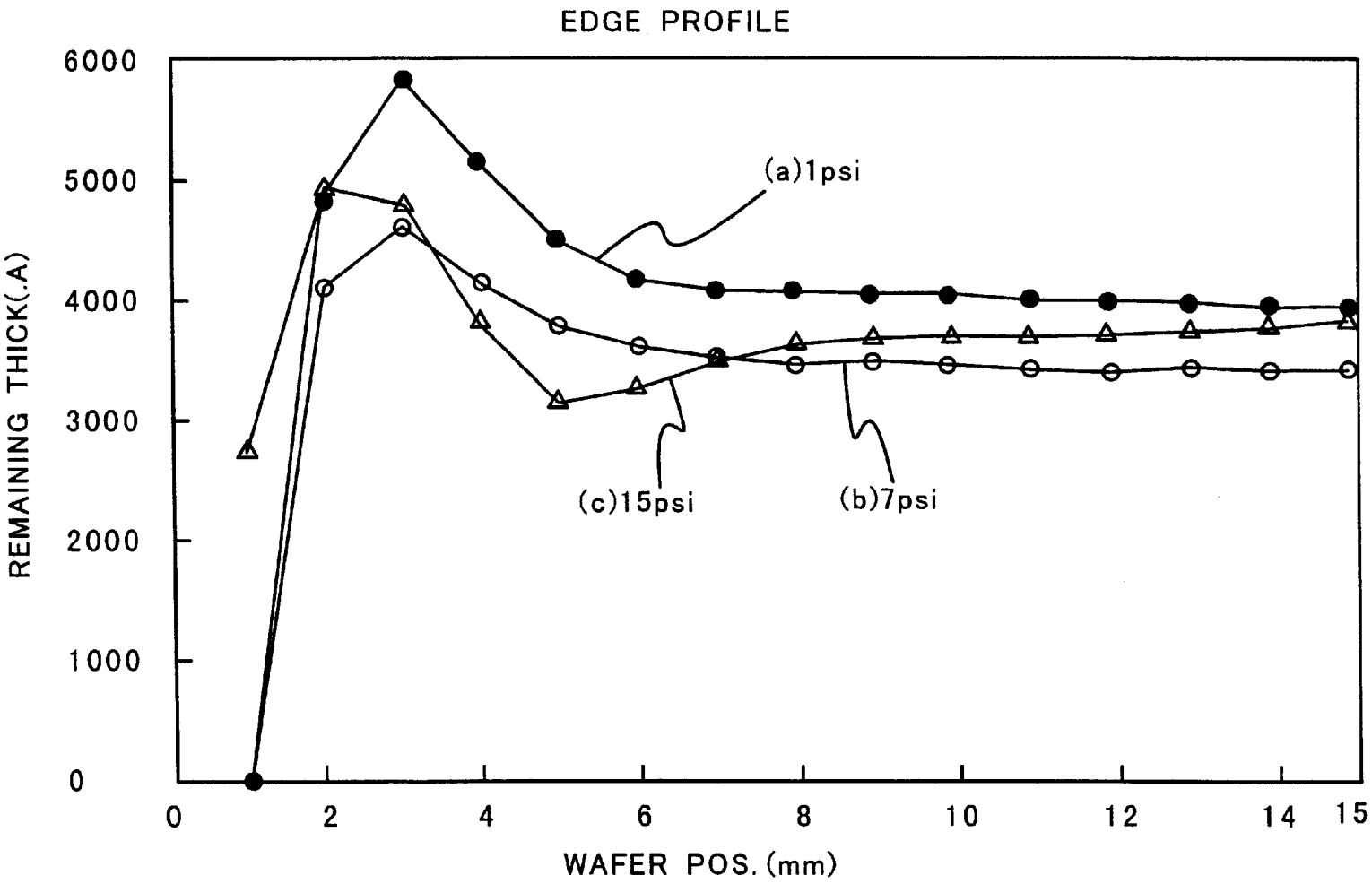
FIG. 3 is a graph showing a relationship between a pressurizing force of the retainer of the first embodiment of the wafer polishing apparatus shown in FIG. 1 and a shape of an outer peripheral portion of the wafer.

At this time, the retainer 9 certainly maintains polishing flatness of the outer peripheral portion of the wafer 1 by depressing the abrasive cloth 3 at a predetermined pressure by the compressed air supplied into the inside of the bellows 11 through the flow path of an air tube 12 and the retainer base 8. It has been know that polishing flatness of the outer peripheral portion of the wafer can be degraded by either excessively large or small pressure of the retainer 9 depressing the abrasive cloth 3. FIG. 3 is a graph showing a relationship between the pressurizing force of the retainer 9 and the shape of the outer peripheral portion of the wafer 1, in which the horizontal axis represents a position in the radial direction from the outer periphery of the wafer 1 to the center, and the vertical axis of the remaining thickness of the wafer 1. In FIG. 3, respective linked lines (a), (b), (c) show remaining thickness when the depression forces are 1 psi, 7 psi and 15 psi, respectively. As shown in FIG. 3, when depression force of the retainer 9 can have high flatness at 7 psi and flatness can be degraded at 1 psi and 15 psi. Accordingly, the compressed air to be supplied to the bellows 11 is set at a pressure where polishing flatness becomes optimal. It should be noted that since the pressurizing force of the retainer 9 where the polishing flatness is optimal, is differentiated depending upon characteristics of the abrasive cloth or apparatus per se, preliminary evaluation is necessary.

During polishing operation, the abrasives 4 flows into the polishing surface of the wafer from a plurality of the grooves 10 provided on the retainer 9. Accordingly, since flow amount of the abrasives 4 can be differentiated at the portion where the groove 10 is present and the portion where the groove 10 is not present. Therefore, fluctuation of polishing amount can be caused in the circumferential direction of the wafer unless certain measure is taken. Therefore, in the shown embodiment, the carrier head 6 and the retainer 9 are designed for independent rotation across the cross roller bearing 7. Therefore, even when the carrier head 6 and the wafer 1 are rotated, rotation of the retainer 9 is prevented by contacting the stopper 15 fixed to the non-rotatable pressurizing mechanism 14 and the shaft. By this, speed difference is caused between rotation of the wafer 1 and rotation of the retainer 9 to cause relative rotation of the grooves 10 with respect to the circumference of the wafer 1. Therefore, inflow amount of the abrasives 4 can be unified in the circumferential direction of the wafer 1.

Figure 4:
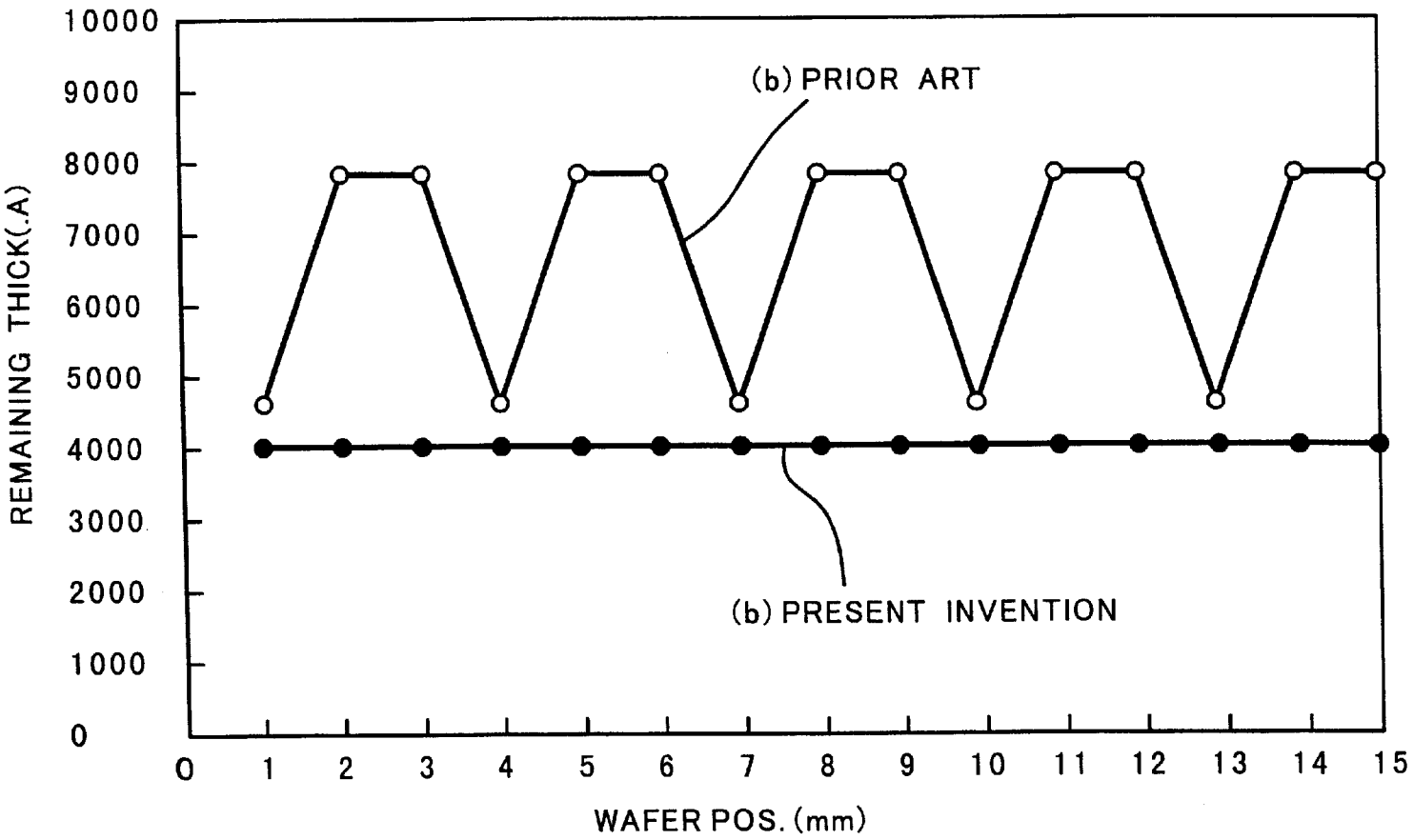
FIG. 4 is a graph showing a shape of polishing in a circumferential direction of the outer peripheral portion of the wafer.

FIG. 4 is a graph showing a polished shape in the circumferential direction of the outer peripheral portion of the wafer, in which the horizontal axis represents a position in a radial direction from an outer peripheral portion of the wafer toward the center, and a vertical axis represents a residual layer thickness of the wafer. In FIG. 4, (a) represents a polished shape when the present invention is applied, and (b) is the conventional polished shape. In the conventional wafer polishing apparatus, the wafer and the retainer are rotated in synchronism with each other, the inflow amount of the abrasives is differentiated at the portion where the groove is present and the portion where the groove is not present to correspondingly cause lowering of yield. In contrast to this, when polishing is performed by the shown embodiment of the wafer polishing apparatus, the wafer 1 can be uniformly polished in the circumferential direction as represented by line (a) of FIG. 4.

It should be noted that, in the present invention, the construction for generating a rotation speed difference between the wafer 1 and the retainer 9 is not particularly restricted to the shown embodiment. As the bearing for independent rotation, various anti-friction bearings, such as ball bearing, needle roller and so forth, various plain bearings by sliding members and so forth may be used. Also, it is possible to form a replacement of the bearing by forming the retainer base 8 and the retainer 9 per se with the sliding members. As a rotation preventing mechanism for the retainer 9, a construction to press a high friction member onto the side surface of the retainer 9. In this case, by adjusting a pressing force of the member, the rotation speed difference can be controlled in certain extent.

On the other hand, it is also possible to form the bottom surface of the retainer 9 with the high friction member to provide large friction force with the abrasive cloth 3 to restrict rotation. In short, any construction which can cause speed difference in rotation of the wafer 1 and rotation of the retainer 9, can be employed.

Furthermore, means for depressing the retainer 9 also can be a plurality of coil springs, a ring shaped leaf spring and various other construction, in addition to pressurization by the bellows and the compressed air.

On the other hand, in certain performance of the polishing bed 2, it is possible to cause tilting or vertical displacement of the abrasive cloth 3 during polishing operation. At this time, a tiltable joint may be employed in connection between the carrier head 6 and the spindle 13. For example, in case of a rotatable joint, such as spherical joint or the like, a pin or the like may be employed for transmitting the rotational force.

Figure 5:
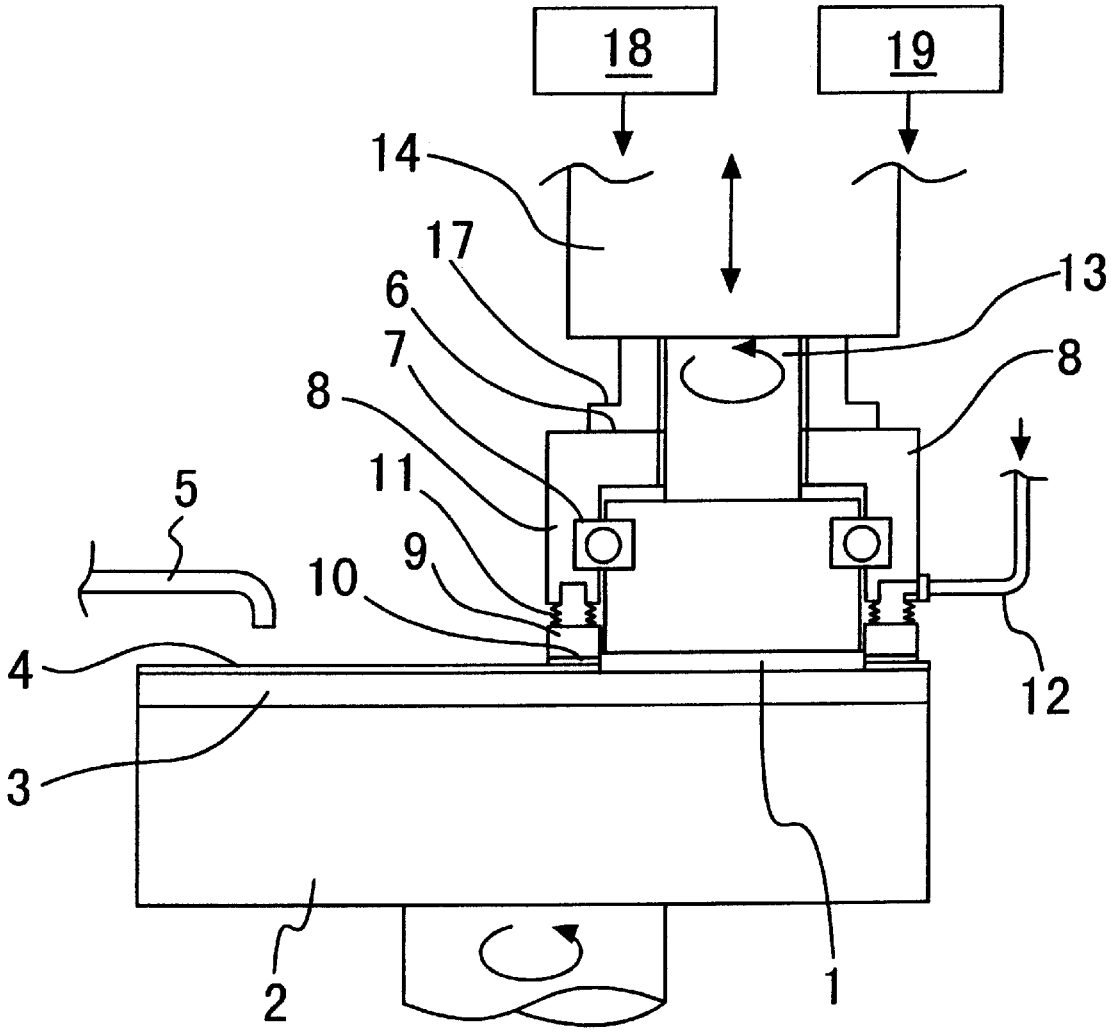
FIG. 5 is an illustration showing a construction of the second embodiment of the wafer polishing apparatus according to the present invention.

FIG. 5 is an illustration showing a construction of the second embodiment of the wafer polishing apparatus according to the present invention. The wafer polishing apparatus shown in FIG. 5 employs a rotation speed difference generating means independently comprises a first rotation control portion 18 and a second rotation control portion which control a rotating direction and a rotating speed of the retainer 9 and a retainer spindle 17 which rotates independently of the spindle 13 driving to rotate the wafer 1 together with the carrier bed 6 and connected to the retainer base 8 for driving the retainer base 8 and the retainer 9 to rotate independently of the wafer 1, in place of the rotation preventing mechanism by contact of the stopper 15 and the shaft 16 as in the first embodiment. Other constructions are the same as those in the first embodiment. Therefore, description for those common components will be neglected in order to avoid redundant discussion for keeping the disclosure simple enough to facilitate clear understanding of the present invention.

Figure 6:
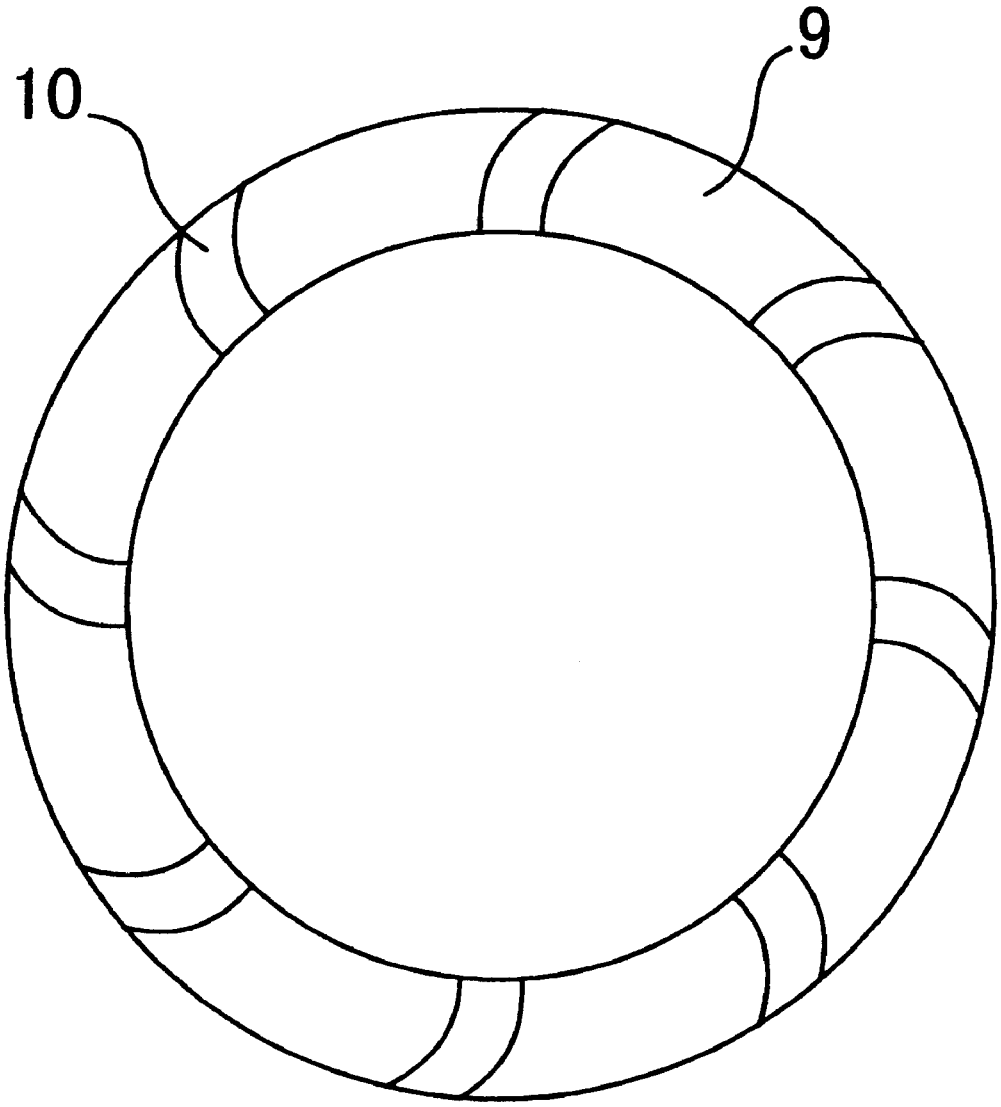
FIG. 6 is a plan view showing an embodiment where grooves are provided in the retainer of the second embodiment of the wafer polishing apparatus shown in FIG. 5.

FIG. 6 is an illustration showing the second embodiment of the grooves 10 provided in the retainer 9. The grooves are formed into shapes extending along streamlines of the abrasives determined by the rotation speed of the polishing bed 2 and the rotation speed of the retainer 9.

Figure 7:
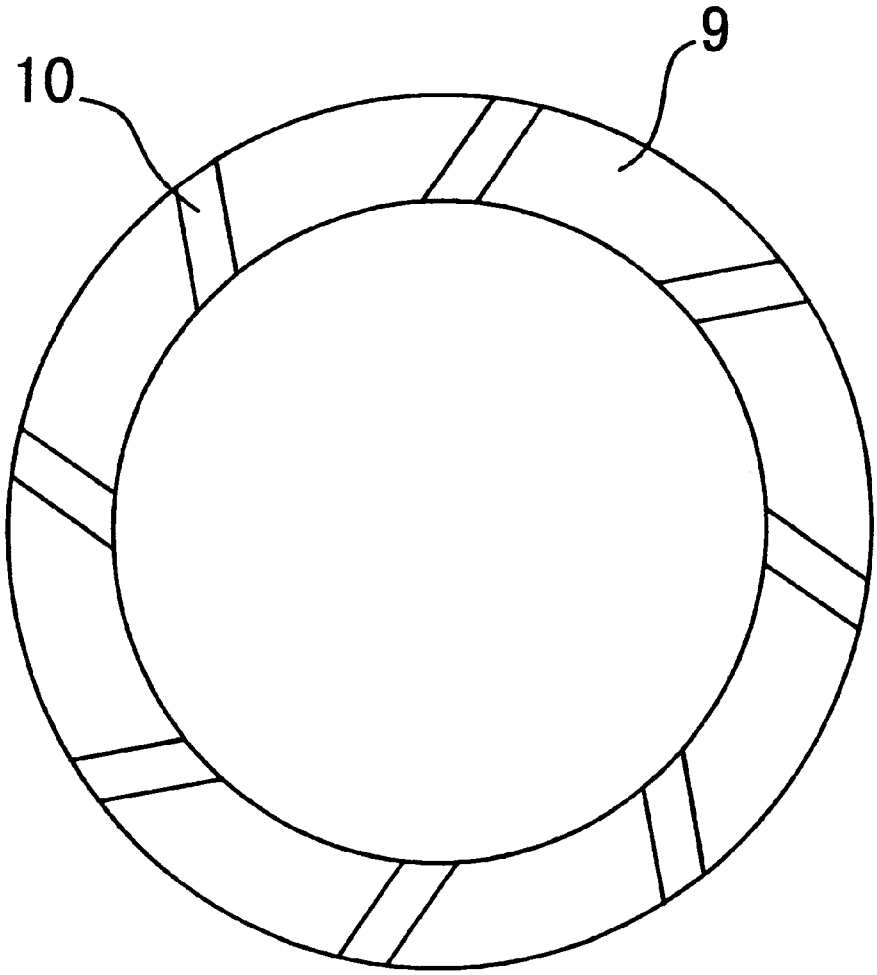
FIG. 7 is a plan view showing an embodiment where grooves are provided in the retainer of the second embodiment of the wafer polishing apparatus shown in FIG. 1.

On the other hand, FIG. 7 is an illustration showing the third embodiment of the grooves 10 provided in the retainer 9. The grooves 10 are in linear shaped configuration extending oblique relative to a plurality of straight lines extending through a center point of the wafer with a given angle.

Next, operation will be discussed.

In the shown embodiment and the first embodiment, the basic operations are similar to each other and merely differentiated in operation of generating rotation speed difference between the wafer 1 and the retainer 9.

In the shown embodiment, by the first rotation control portion 18 and the second rotation control portion 19, rotations of the spindle 13 and the retainer spindle 17 are differentiated by controlling the rotation speeds or rotation directions, respectively. Accordingly, rotation of the wafer 1 and rotation of the retainer 9 can be selected to set a condition where both of the wafer 1 and the retainer 9 are rotating in the same direction at mutually different speeds, a condition where the water and the retainer 9 are rotating in mutually opposite directions, and a condition where the only wafer 1 rotates and the retainer 9 stops, depending upon selection of characteristics of the abrasive cloth 3 or the polishing apparatus per se.

On the other hand, in the shown embodiment, rotation of the retainer spindle 17 can be controlled at a constant speed by the second rotation control portion 19. In this case, as shown in FIG. 6, the grooves 10 formed to extend along the streamline of the abrasives 4 determined by the rotation speed of the polishing bed 2 and the rotation speed of the retainer 9, exhibit better inflow characteristics of the abrasives 4. When an improvement of the inflow characteristics can be achieved in certain extent, or when polishing operation with varying rotation speed is performed, as shown in FIG. 7, the grooves 10 may be a straight line shape extending oblique relative to a plurality of straight lines extending through the center point of the wafer 1.

Figure 8:
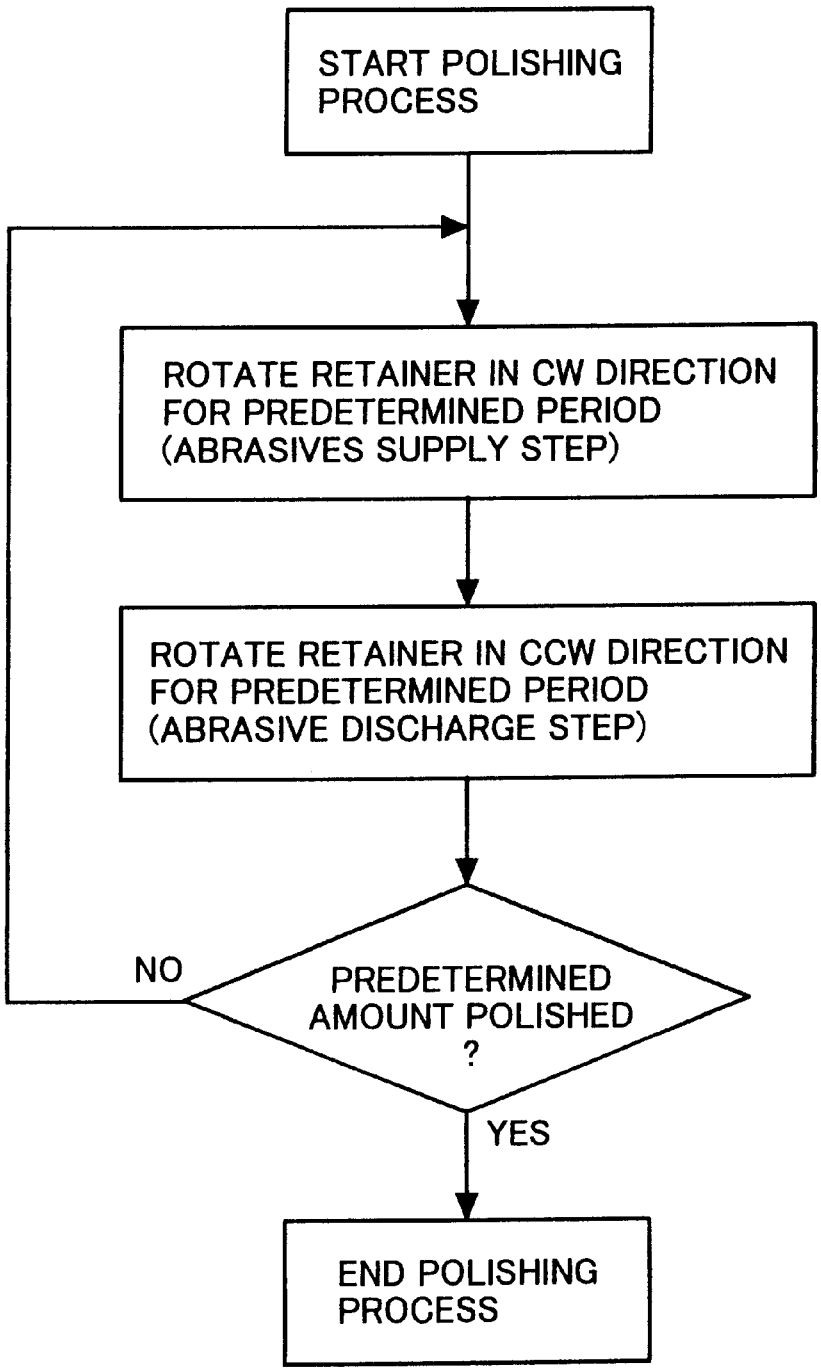
FIG. 8 is a flowchart showing one embodiment of a wafer polishing method according to the present invention.
Figure 9:
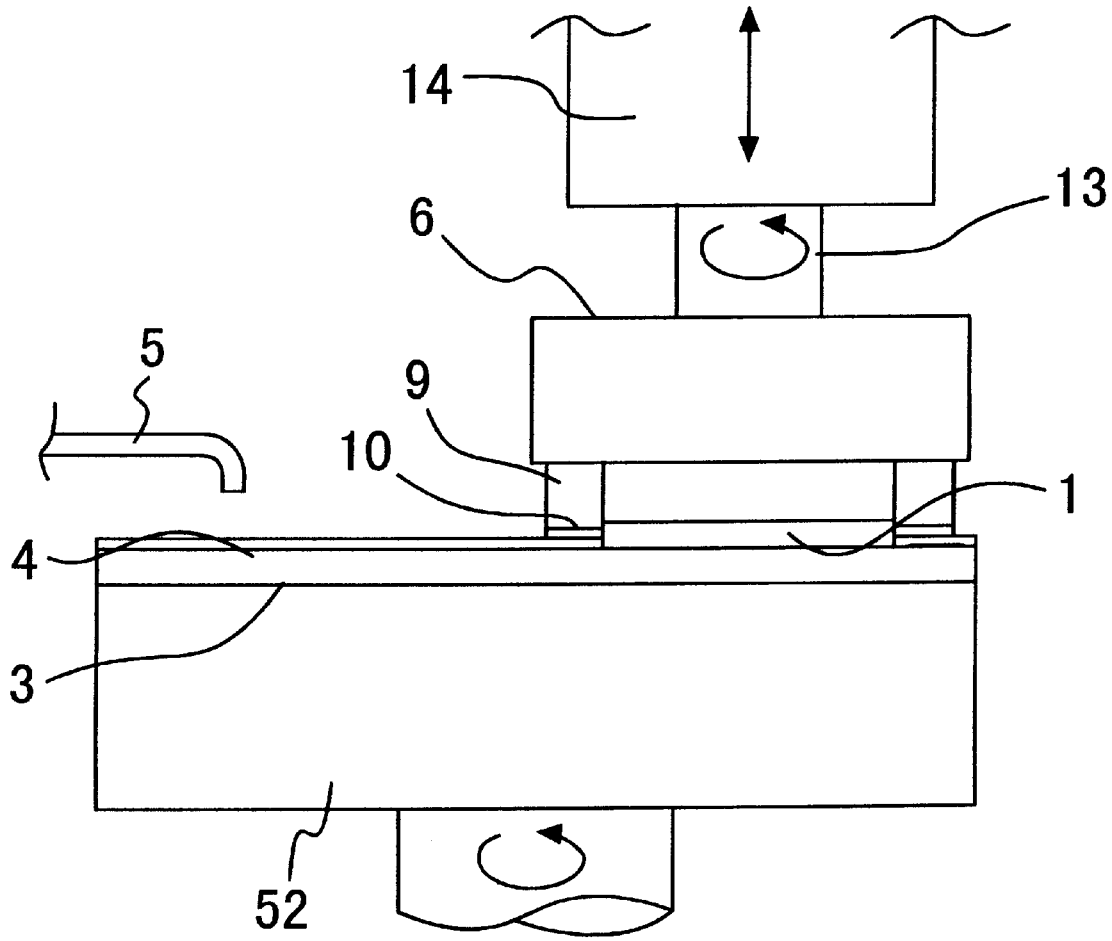
FIG.9 PRIOR ART
FIG. 9 is an illustration showing a construction of the conventional wafer polishing apparatus.
Figure 10:
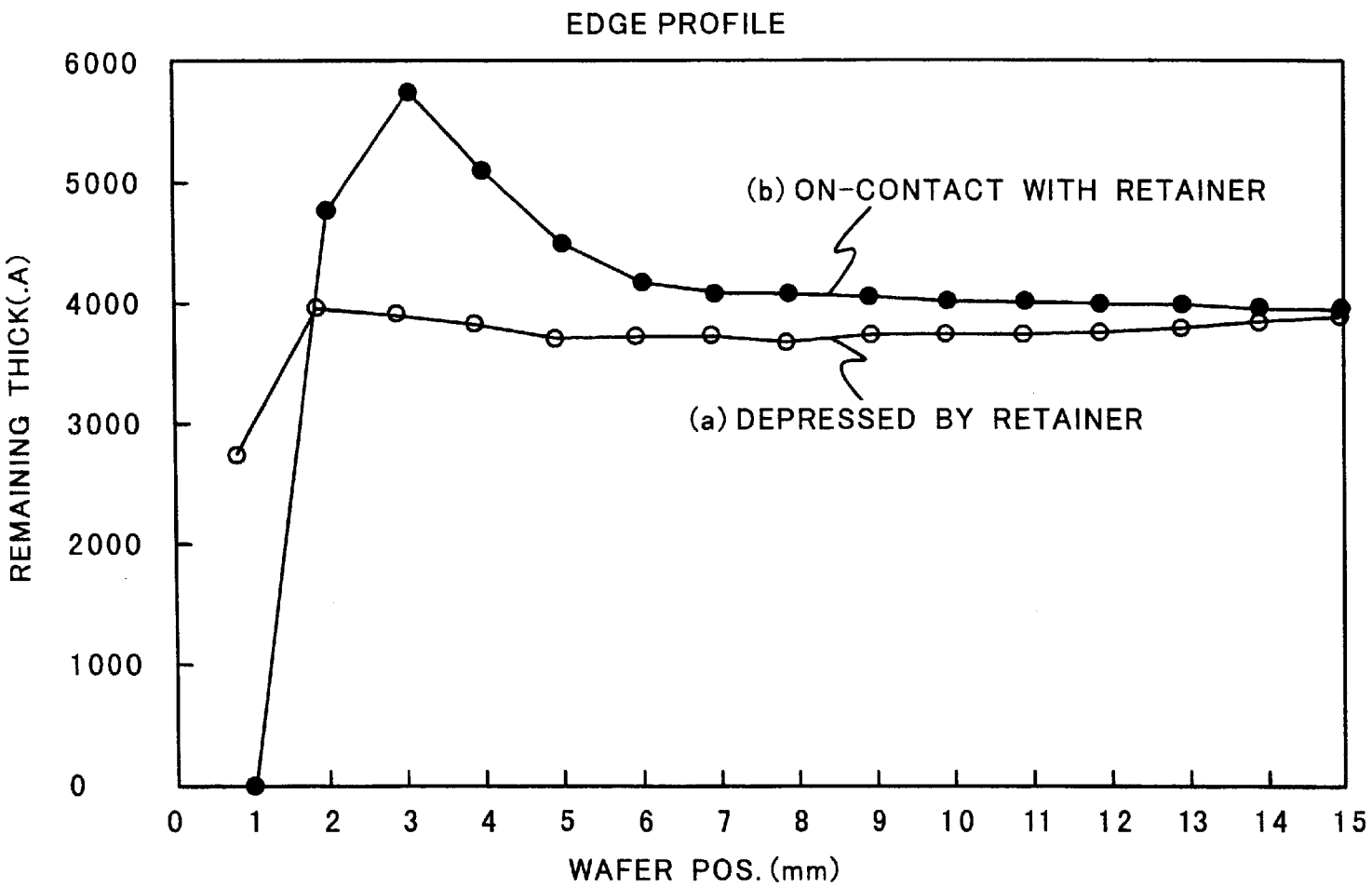
FIG.10 PRIOR ART
FIG. 10 is an explanatory illustration showing comparison of flatness of polishing surfaces in the cases where a polishing surface is depressed by means of the retainer and where the retainer is held in non-contact with the polishing surface.

FIG. 8 s a flowchart showing one embodiment of the wafer polishing method according to the present invention. The wafer polishing method shown in FIG. 8 is characterized by alternately repeating a step of rotating the retainer 9 in clockwise (CW) direction in order to supply the abrasives 4 to the polishing surface of the wafer 1 and a step of rotating the retainer in a counterclockwise (CCW) direction in order to discharge the abrasives 4 from the polishing surface of the wafer 1. It should be noted that rotating direction is the direction as viewed from the surface contacting with the abrasive cloth 3 of the retainer in the grooves of the shapes shown in FIGS. 6 and 7 during polishing operation. If the grooves 10 are formed to tilt in the opposite direction, rotating directions of supplying and discharging of the abrasives become opposite.

Next, discussion will be given for operation.

After initiation of polishing, at first, the retainer 9 is driven to rotate in the CW direction. In this rotating direction, by tilting of the grooves 10, the abrasives 4 are positively drawn into the retainer 9. Therefore, the abrasives 4 are supplied to the polishing surface of the wafer 1. However, the abrasives 4 cannot be discharged in sufficient amount, polishing chip or reaction product between the surface of the wafer 1 and the abrasives 4 can be accumulated below the polishing surface of the wafer 1 to cause scratching or lowering of the polishing speed. Therefore, next, after elapsing of a given period, the retainer 9 is driven to rotate in the CCW direction. In this case, conversely to the CW direction, the abrasives 4 are positively discharged from the polishing surface of the wafer 1, the polishing chip or reaction product can be removed from the portion below the polishing surface of the wafer. After discharging operation, the step of rotating the retainer 9 in the CW direction is performed again to progress polishing. By alternately repeating supply and discharge of the abrasives until finishing of polishing, polishing of the wafer 1 can be performed without occurrence of scratch or lowering of the rotation speed.

As set forth above, in the wafer polishing apparatus according to the present invention, instead of causing synchronous rotation of the wafer and the retainer, speed difference is caused between the wafer and the retainer having the grooves. Therefore, inflow amount of the abrasives to the wafer can be unified in the circumferential direction of the wafer to make the polishing amount in the circumferential direction of the wafer uniform to improve production yield.

On the other hand, in the wafer polishing method according to the present invention, instead of constantly supplying and discharging of the abrasives to the wafer polishing surface, the steps of supplying and discharging of the abrasives are repeated alternately. Thus, polishing chip and reaction product generated associating with progress of polishing may not be accumulated below the polishing surface of the wafer to avoid occurrence of scratch of the surface of the wafer and enable to maintain the polishing speed constant.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A wafer polishing apparatus comprising:

a rotary polishing bed;

an abrasive cloth provided on said polishing bed;

abrasives supplying means for supplying abrasives to a surface of said abrasive cloth;

wafer depressing means for depressing said wafer onto said abrasive cloth at a first pressure;

a ring shaped retainer arranged surrounding said wafer and provided with a plurality of grooves extending between an inner peripheral edge and an outer peripheral edge on a surface contacting with said abrasive cloth;

rotary driving means for driving said wafer and said retainer on said abrasive cloth; and rotation speed difference generating means for providing a difference of rotation speeds between said wafer and said retainer.

2. A wafer polishing apparatus as set forth in claim 1, wherein said plurality of grooves provided in said retainer extend along a plurality of straight lines extending through a center point of said wafer and are linear shaped configuration.

3. A wafer polishing apparatus as set forth in claim 1, wherein said plurality of grooves provided in said retainer extend along predetermined streamlines of said abrasives determined by a rotation speed of said polishing bed and the rotation speed of said retainer.

4. A wafer polishing apparatus as set forth in claim 1, wherein said plurality of grooves provided in said retainer extend oblique with respect to a plurality of straight lines extending through the center points of said wafer at a predetermined angle and are linear shaped configuration.

5. A wafer polishing apparatus as set forth in claim 1, wherein said plurality of grooves provided in said retainer extend oblique with respect to a plurality of straight lines extending through the center points of said wafer at a predetermined angle and are curved shaped configuration.

6. A wafer polishing apparatus as set forth in claim 1, wherein rotation speed difference generating means comprises a bearing disposed between said rotary driving means for driving to rotate said wafer and said retainer, and said retainer, and rotation preventing means for preventing rotation of said retainer.

7. A wafer polishing apparatus as set forth in claim 1, wherein said rotary driving means is provided for each of said wafer and said retainer independently of the other, and said rotation speed difference generating means includes two rotation control means respectively controlling rotating direction and rotation speed of respective rotary driving means independently of the other.

8. A wafer polishing method comprising the steps of:

supplying an abrasive to a surface of an abrasive cloth provided on a rotary polishing bed;

driving a wafer as an object for polishing and a retainer arranged surrounding said wafer for rotation with depressing said wafer onto said abrasive cloth at a first pressure by said retainer; and causing a difference of rotation speeds of said wafer and said retainer.

9. A wafer polishing method comprising the steps of:

supplying an abrasive to a surface of an abrasive cloth provided on a rotary polishing bed;

driving a wafer as an object for polishing and a retainer arranged surrounding said wafer for rotation with depressing said wafer onto said abrasive cloth at a first pressure by said retainer, in which said abrasive is supplied to a surface of said wafer to be polished in one rotating direction of said wafer and said retainer, and said abrasive is discharged from said surface of said wafer to be polished in the other rotating direction; and switching rotating direction between said one direction to the other direction.

10. A wafer polishing method as set forth in claim 9, wherein a plurality of grooves extending oblique relative to straight lines extending through a center point of said wafer with a predetermined angle, are provided on a surface of said retainer contacting with said abrasive cloth, in such a manner that said abrasive is supplied to a surface of said wafer to be polished in one rotating direction of said wafer and said retainer, and said abrasive is discharged from said surface of said wafer to be polished in the other rotating direction.

11. A wafer polishing method as set forth in claim 9, wherein switching of rotating direction of rotation of said retainer on said abrasive cloth is repeated according to a fixed sequence.

* * * * *